United States Patent [19]

Redding

[11] 4,103,298

[45] Jul. 25, 1978

[54] ALARM DEVICE

[75] Inventor: Robert J. Redding, Maidenhead, England

[73] Assignee: Browne-Davies Electronic Corporation, Houston, Tex.

[21] Appl. No.: 707,110

[22] Filed: Jul. 20, 1976

[51] Int. Cl.[2] ..... H05B 41/00

[52] U.S. Cl. ..... 340/331; 340/333; 340/532; 340/693

[58] Field of Search ..... 340/331, 105, 333

[56] References Cited

U.S. PATENT DOCUMENTS

| | | | |
|---|---|---|---|
| 3,024,386 | 3/1962 | Chauvineau | 340/105 |
| 3,278,895 | 10/1966 | Pfund | 340/331 |
| 3,641,491 | 2/1972 | Bath | 340/105 |
| 3,846,750 | 11/1974 | Kearsley | 340/105 |
| 3,973,168 | 8/1976 | Kearsley | 340/331 |

*Primary Examiner*—Thomas B. Habecker
*Attorney, Agent, or Firm*—Arthur M. Dula; Murray Robinson; Ned L. Conley

[57] ABSTRACT

An indicator device for providing a high-intensity visual indication of an occurrence comprises a flash tube which is fed with a high voltage from a capacitor, the capacitor being charged by means energized from an intrinsically safe supply. Trigger pulses are applied to the flash tube in response to the occurrence, so that the tube emits flashes in response thereto. An annunciator can comprise a plurality of the devices housed in a single unit and fed from a single power supply.

11 Claims, 5 Drawing Figures

ALARM DEVICE

This invention relates to indicator devices for providing a visual indication of an occurrence, particularly but not exclusively the occurrence of a hazard or dangerous condition, in order to draw attention to the occurrence or to warn personnel not to enter a location or area.

The invention is particularly useful in hazardous industrial environments where there is a risk of fire and/or explosion due to the presence of flammable materials or atmosphere in places such as chemical plants, oil refineries and off-shore installations. It is especially advantageous in areas where the ambient noise level is so high that a klaxon, a bell or a loudspeaker system is ineffective. It also has advantages over known visual devices which use large, high power-consumption filament lamps, requiring special safety enclosures and heavy supply cables.

The present invention has the added advantage that the electrical circuit is intrinsically safe, i.e. that it is incapable of causing fire or explosion by generating high energy electrical sparks. Furthermore, the device can be made to operate for a limited period after the power supply has failed. In addition, it is more convenient and cheaper to make than known visual indicators using incandescent lamps.

According to the invention, an indicator device comprises a flash tube; a capacitor coupled across the flash tube; and means to charge the capacitor from an intrinsically safe power supply and to discharge the capacitor through the flash tube in response to an occurrence to provide a visual indication of said occurrence.

Preferably the device is encapsulated in a protective material, such as a resin.

Figure 1B:
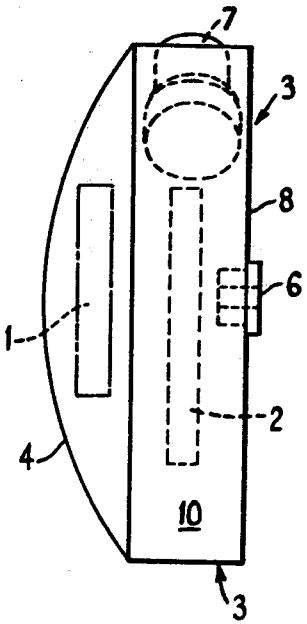
Figure 1A:
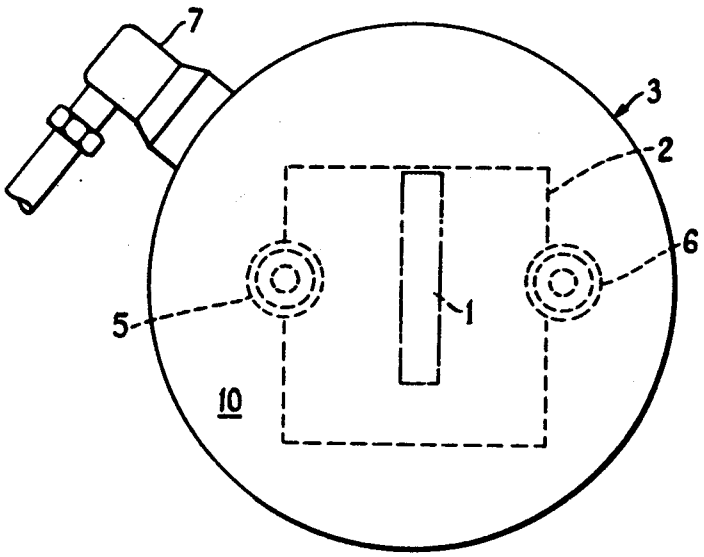
Figure 2:
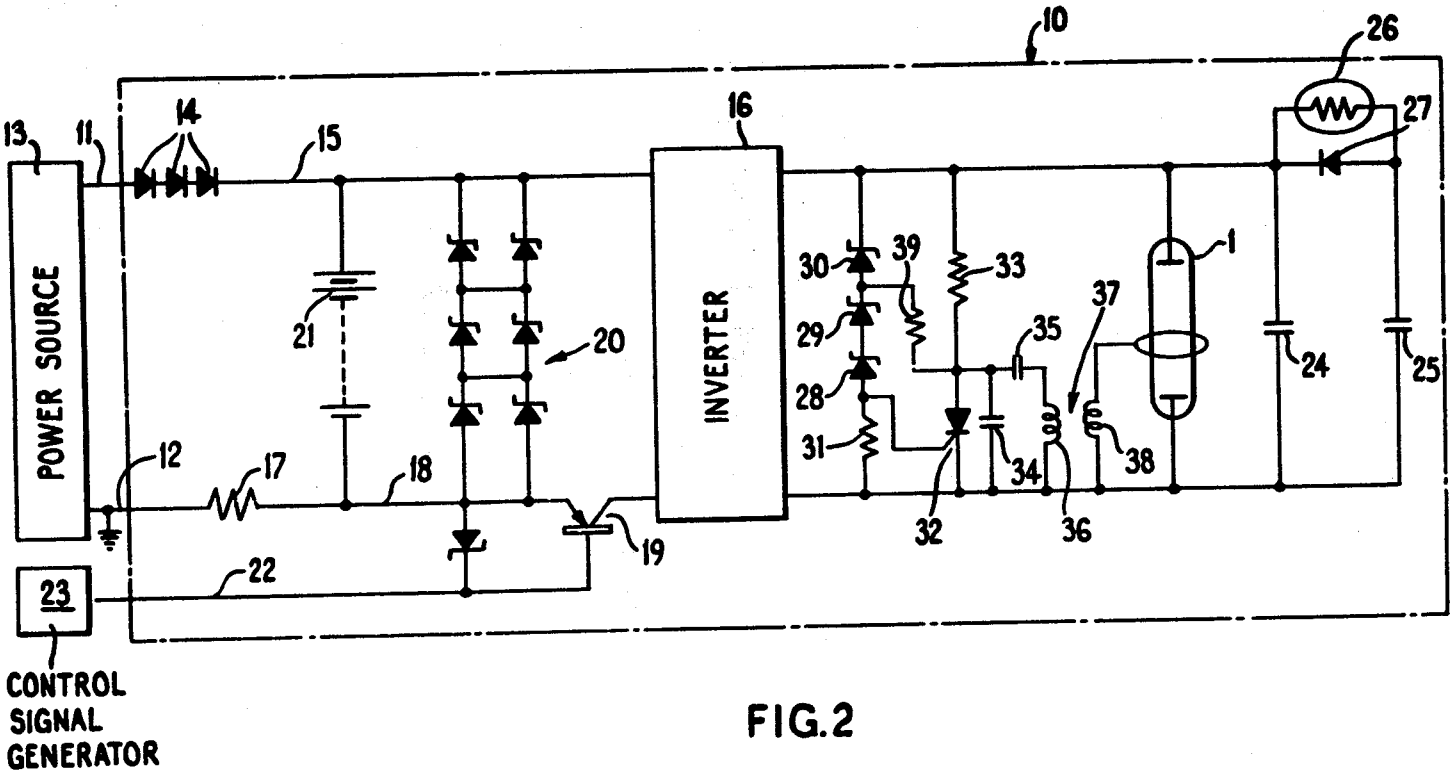
Figure 3:
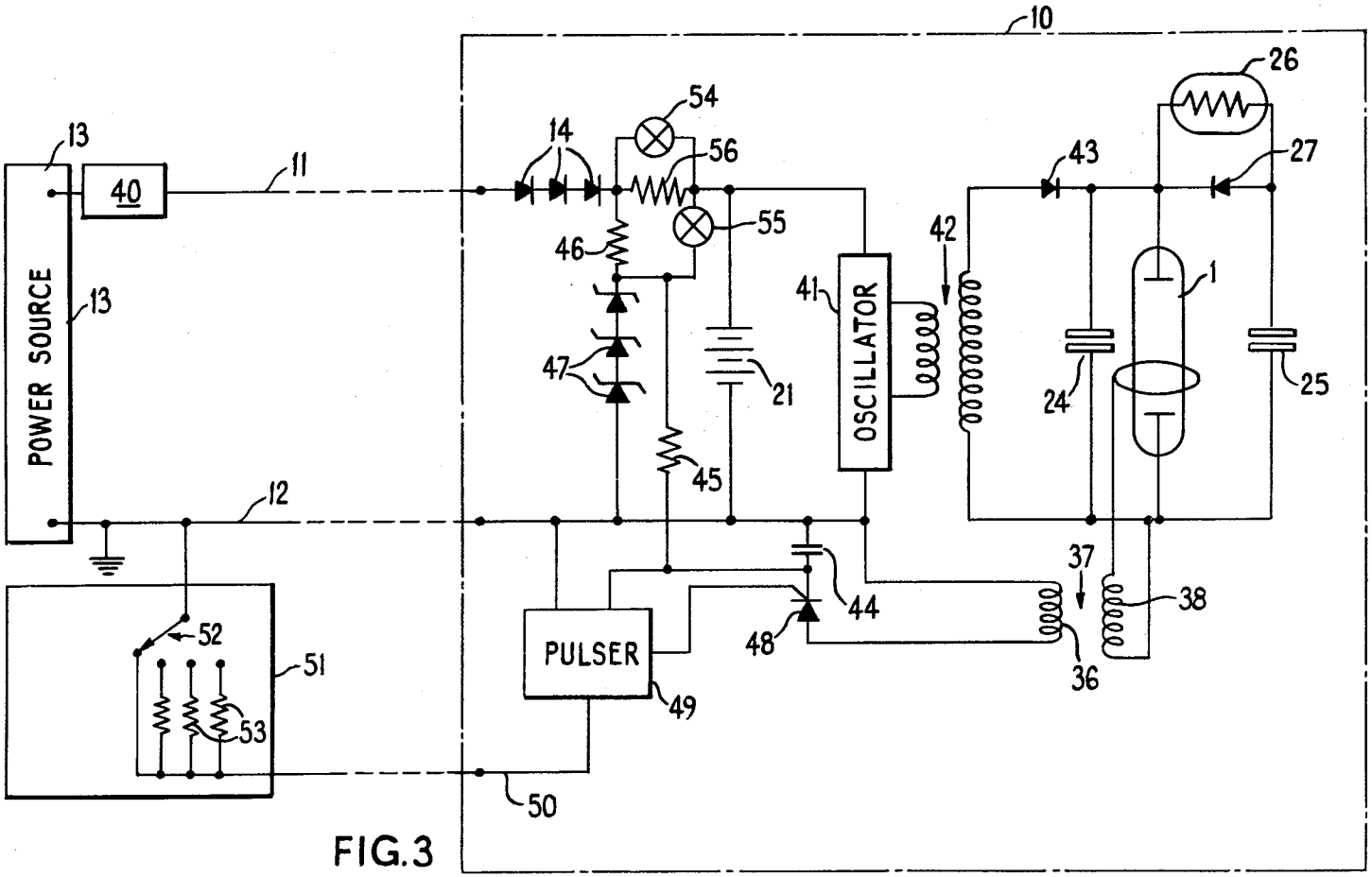
Figure 4:
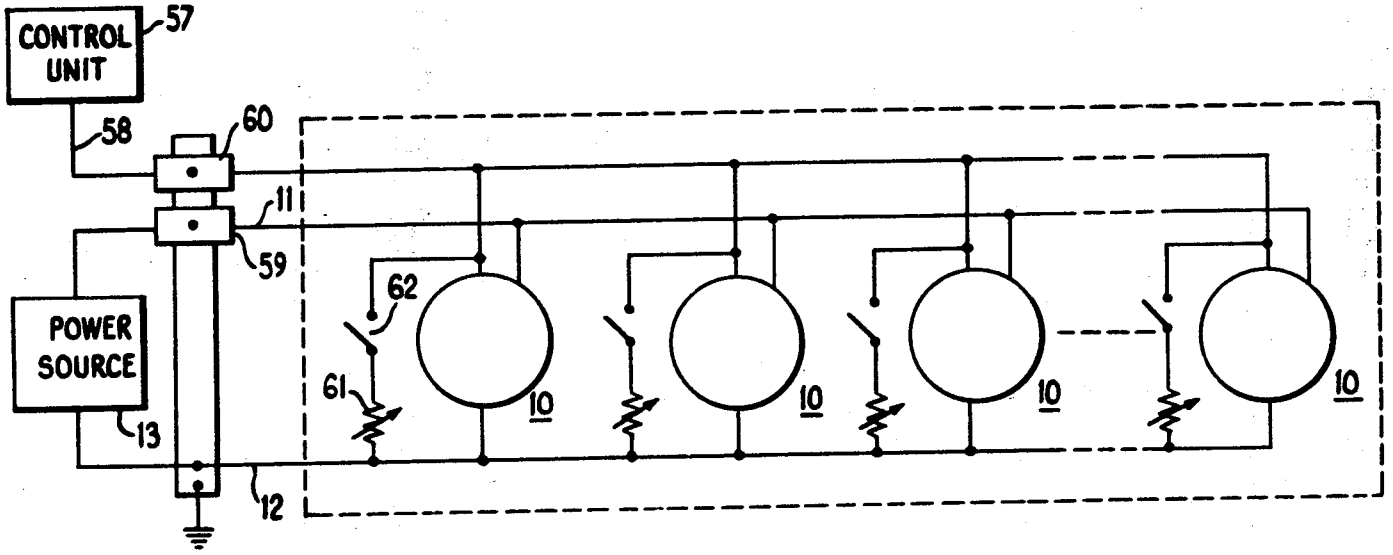

Embodiments of the invention will now be described, by way of example, with reference to the accompanying drawings, in which:

FIGS. 1*a* and *b* are schematic front and side elevations, respectively, of an indicator device in accordance with the invention, FIG. 2 is a diagram of one circuit arrangement of such device, FIG. 3 is a diagram of a second circuit arrangement, and FIG. 4 is a schematic diagram of an annunciator comprising a plurality of indicator devices.

Referring to FIG. 1 of the drawings, an indicator device comprises a xenon-filled flash tube 1 and control circuitry 2 which are encapsulated in a block 3 of resin material. The block 3 has a domed transparent or translucent front portion 4 through which light from the flash tube 1 emerges. A cylindrical base section 8 of the block 3 may also be transparent or translucent, but is preferably opaque. Two internally-threaded bushes 5 and 6 are cast into the back of the block 3 so that the device can be screwed to a mounting surface such as a bulk-head. A three-pin connector 7 is fitted to the base section 8 for connection of control and power supply lines to the device. The domed front 4 of the block 3 may include a luminous or fluorescent powder to provide an after-glow, so that a substantially continuous emission of light is obtained whilst the flash tube is emitting short bursts of light output.

In response to an occurrence, such as one of those mentioned above, a signal is applied to (or removed from) the control line, and the flash tube is pulsed, causing it to emit very brief flashes of light of high intensity.

It is advantageous to generate very short bursts of light for two reasons. Firstly, economy in the use of electrical power is effected, and secondly the energy of the flash is reduced to a level which will not cause saturation of the eyes or temporary blinding of an observer.

Referring to FIG. 2 of the drawings, one suitable circuit for the device 10 is illustrated therein. The device 10 is supplied with power over lines 11 and 12 from an intrinsically safe 24v d.c. source 13. A string of diodes 14 connected to the line 11 prevent the possibility of dangerous voltages being fed back on to the line 11 from the device 10. The output from the diodes 14 is fed to a line 15 which is connected to an inverter circuit 16. The grounded line 12 is connected via a resistor 17 to a line 18 which feeds the inverter 16 via a transistor switch 19. A nickel cadmium battery 21 is trickle charged by the voltage between the lines 15 and 18 and will energise those lines for a period in the event of failure of the supply from the source 13. A seriesparallel network 20 of zener diodes is connected between the lines 15 and 18 as a temperature compensated chain to avoid overcharging the battery.

The base electrode of the transistor 19 is connected via a line 22 to a control signal generator 23. The transistor 19 is protected by a zener diode 23 connected between its base and emitter electrodes.

A signal from the generator 23 turns on the transistor 19, thereby connecting the supply on the lines 15 and 18 to the inverter 16. The inverter generates a high voltage for charging capacitors 24 and 25. The capacitor 24 is connected across the flash tube 1, and the capacitor 25 is connected to the flash tube via a light-sensitive resistor 26 and a diode 27. The diode 27 is of such polarity that the capacitor 25 charges only through the resistor 26 but can discharge into the flash tube 1 through the very low impedance of the diode.

A trigger circuit for the flash tube includes zener diodes 28–30 and a resistor 31 connected in series across the inverter output. A thyristor 32 is connected in series with a resistor 33 across said output. The gate electrode of the thyristor is connected to the junction of the resistor 31 and the diode 28. A capacitor 34 is connected in parallel with the thyristor 32, whilst a series circuit comprising a capacitor 35 and the primary winding 36 of a pulse transformer 37 is also connected across the thyristor. The secondary winding 38 of the transformer 37 is connected to a trigger electrode of the flash tube 1. A resistor 39 is connected between the anode of the thyristor 32 and the junction between the diodes 29 and 30.

The capacitor 34 is continuously charged via the resistor 33 and discharged via the thyristor 34 so that a train of pulses is applied to the trigger electrode of the flash tube, each of the pulses causing it to conduct and discharge the capacitors 24 and 25 so that the tube emits a very intense light flash. Between the pulses, the capacitor 24 recharges rapidly from the inverter output but the capacitor 25 recharges less rapidly due to the presence of the resistor 26. The greater the ambient light intensity the less the value of the resistance 26, so that the charge on the capacitor 25 reaches a higher level between pulses if the ambient light level around the device is high. Hence, a very high intensity light flash is emitted from the tube 1 in bright daylight and a lower intensity flash in surrounding darkness.

Referring now to FIG. 3 of the drawings, an alternative circuit is shown therein. Certain of the components have the same functions as in FIG. 2 and are given the same reference numerals. Such components will not be described again.

In this case, power is supplied from the source 13 to the line 11 via a zener diode safety barrier 40 so that the supply on the line 11 is intrinsically safe. The capacitors 24 and 25 are charged from the output of an oscillator 41 via a pulse transformer 42 and a rectifier diode 43. Pulses fed to the trigger electrode of the flash tube 1 via the pulse transformer 37 are derived from a capacitor 44 which is charged, via a resistor 45, from a stabilised d.c. supply derived from a network comprising a resistor 46 and zener diodes 47 connected between the output of the diodes 14 and the line 12. The capacitor 44 is discharged through the pulse transformer primary winding 36 by a thyristor 48. The gate electrode of the thyristor is fed with firing pulses from a pulser circuit 49.

The firing pulse repetition rate is controlled by the connection of selected resistance values between a control line 50 and the line 12. The selection of the values is carried out in a control unit 51 which comprises a selector switch 52 and a plurality of different value resistors 53. In an end switch position the line 50 is directly connected to the line 12, and operation of the pulser circuit 49 is thereby inhibited.

The switch 52 may be automatically operated and may be an electromechanical switch or a solid state electronic switch so that, for example, attention can be called to an occurrence by a fast flashing rate (e.g. 1 flash per second) and the rate can be reduced by automatically decreasing the value of the resistance between the lines 12 and 50 when observation of the flashing is confirmed by, for example, pressing of an acknowledgment button (not shown). Alternatively, or in addition, the light intensity of the flashes can be reduced in response to pressing of the acknowledgment button.

Furthermore, the rate of flashing and/or the intensity can be changed continuously so that the flashes are emitted in a code sequence in order to impart to the observer information as to, for example, different types of fault condition. Logic circuitry to produce the required code can be built into the encapsulation block.

The switch 52 may be operated by any suitable sensor device, as a result of overheating, leakage, flooding, or any other occurrence, to initiate the fast flashing of the flash tube.

The operation of the indicator device is monitored by light emitting diodes 54 and 55. The LED 54 is connected across a resistor 56 in series with the power supply to the oscillator 41, whilst the LED 55 is connected across the resistor 46. The LED 54 is therefore illuminated when there is a potential difference between the ends of the resistor 56, i.e. when current is flowing to the oscillator circuit. This LED therefore indicates that the device is activated, ready for light emission when trigger pulses are fed to the flash tube 1. The LED 55 is illuminated when the positive output terminal of the battery 21 is at a sufficiently high potential relative to the junction between the resistor 46 and the chain of diodes 47. This LED therefore indicates a satisfactory state of charge of the battery. Since both LEDs would normally be on when the circuitry is in a proper operative condition, fail-safe operation is achieved.

In the event of a power failure on the lines 11 and 12, the battery 21 will still energise the oscillator 41, but the potential at the junction of the resistor 46 and the diodes 47 will fall. This decrease in potential is communicated to the pulser circuit 49 via the resistor 45, and the pulser circuit responds by applying firing pulses at a relatively low rate, say one every two seconds, to the gate of the thyristor 48, even though the line 50 is in a healthy state (i.e. no outside occurrence is to be indicated). Trigger pulses are therefore applied to the flash tube at that rate, and warning of the failure of the power supply in thereby given.

Referring now to FIG. 4 of the drawings, an annunciator device comprises a plurality of the previouslydescribed indicator devices 10 connected to a common power source 13 and connected to a control unit 57 via a line 58. The line 58 may carry a single command signal or may carry a plurality of signals relating to respective indicator devices by multiplexing. Alternatively, a plurality of lines 58 may be provided, either each corresponding to a respective indicator device, or having signals coded in, say, binary code applied thereto for causing operation of the relevant indicator devices via a decoder. The lines could alternatively be fed to a matrix decoder.

The line 11 and the or each line 58 is fed through a respective safety barrier 59 and 60. Unless the unit 57 and the source 13 are intrinsically safe, they will be mounted in a safe area with the safety barriers.

Flash repetition rate controlling resistors 61 and local switches 62 for cancelling the operation of respective indicator devices may be provided if necessary.

The units 10 may be incorporated in a single casing having a number of labelled windows corresponding to the units 10 and each indicating a different location or type of occurrence.

Instead of each unit 10 having a separate oscillator or inverter to supply the breakdown voltage of the flash tube, a single high voltage source may be provided for all of the flash tubes, the tubes being selectively fired by individual trigger circuits.

Logic circuitry (not shown) may be provided to distinguish between a number of the units 10 in the annunciator. The initial alarm results in a brilliant flashing of one unit 10 at, say, one second intervals to call attention. If action is taken and the alarm is acknowledged, a resistance is inserted in series with the tube which causes the light intensity to drop to a low level, the aforementioned fluorescent powder giving an afterglow to mark clearly that the alarm condition remains, until the tube is extinguished. To distinguish between a number of alarms, on the receipt of a second alarm before the first is acknowledged the second unit 10 flashes at a slower rate. When the acknowledgment button is pressed, the first unit goes to low level flashing and the second now flashes at the faster rate until it is similarly acknowledged.

Further extension of these principles to give a complete picture is possible, if desired. Similarly the time order of acknowledged alarms may be preserved by making the low level flashing differ, and in practice this can be automatically achieved by an electronic integrator or temperature-dependent resistor such that the flashing rate gets slower the longer the alarm condition persists. This has the advantage that a long-standing fault can be indicated without confusing the pattern of more recent ones requiring attention. A reduced consumption of power is achieved. Alternatively, a light emitting diode can be used instead of the flash tube to indicate that a point is permanently on alarm or inoperable.

Although described in the context of alarm indication, the indicator device can be employed for other signalling purposes, for example as a landing aid for helicopters, or for preventive purposes, for example for the scaring of intruders. Furthermore, there are circumstances, for example in residential areas, where loud alarms such as loud telephone bells are undesirable. The present invention can be arranged to provide a very effective silent alarm.

The power requirement is so small that this may be obtained from natural sources, for example solar cells.

I claim:

1. An intrinsically safe strobe system comprising, a high voltage strobe unit comprising, a gas flash tube having a trigger circuit, a capacitor connected in series with the flash tube, a charging power supply whose output is connected in parallel with the flash tube and capable of charging the capacitor to a potential sufficient to ionize the gas in the flash tube and whose input is low voltage, low current intrinsically safe power; said strobe unit being contained in an intrinsically safe enclosure in a hazardous area;

an intrinsically safe power supply located in a safe area whose intrinsically safe power output is electrically connected to the input of said charging power supply in said hazardous area, and triggering means in said enclosure connected to said flash tube's trigger circuit for controllably allowing an electrical signal having an intrinsically safe power level to actuate the flash tube.

2. A strobe system as in claim 1 wherein the strobe unit is encapsulated within a resin.

3. A strobe system as in claim 1 including a battery located in the intrinsically safe housing which is slowly charged from the intrinsically safe power supply and is connected in parallel to the input of the charging power supply, whereby the battery maintains operation of the device after failure of the intrinsically safe power supply.

4. A strobe system as in claim 3 including a light for indicating that the battery is charged.

5. A strobe system as in claim 1 including a fluorescent in the path of the light emitted from the flash tube to provide an afterglow between the flashes.

6. A strobe system as in claim 1 including at least one additional capacitor connected in parallel across said flash tube.

7. A strobe system as in claim 6 including a variable photoresistor connected in series between said additional capacitor and said flash tube.

8. A strobe system as in claim 1 wherein the triggering means is a thyristor.

9. A strobe system as in claim 1 including logic means located in said intrinsically safe enclosure and connected functionally to said triggering means for causing the strobe system to emit a coded sequence of flashes in response to an intrinsically safe electric signal to said logic means.

10. A strobe system as in claim 1 wherein said trigger means is a pulser coupled through a thyristor to the primary of a coil whose secondary is connected to the trigger circuit of the flash tube.

11. A strobe system as in claim 1 wherein the power output of the intrinsically safe power supply is limited by zener barrier strips to below the current and voltage required for the system to be rated as intrinsically safe for the function it is to serve by Underwriter's Laboratories.

* * * * *